United States Patent [19]

Vecchiarelli

[11] 4,352,385

[45] Oct. 5, 1982

[54] TILTER MECHANISM

[75] Inventor: Francis Vecchiarelli, River Edge, N.J.

[73] Assignee: Hunter Douglas International, N.V., Curacao, Netherlands Antilles

[21] Appl. No.: 114,080

[22] Filed: Jan. 21, 1980

Related U.S. Application Data

[63] Continuation-in-part of Ser. No. 43,696, May 30, 1979, abandoned.

[51] Int. Cl.[3] ..... E06B 9/38

[52] U.S. Cl. ..... 160/177

[58] Field of Search ..... 160/166-178 R

[56] References Cited

U.S. PATENT DOCUMENTS 3,828,838 8/1974 Anderle et al. ..... 160/176

3,918,513 11/1975 Englund et al. ..... 160/176 R

*Primary Examiner*—Philip C. Kannan

*Attorney, Agent, or Firm*—Pennie & Edmonds

[57] ABSTRACT

A tilter mechanism for the slats of a venetian blind in which a worm and wormwheel are mounted in a housing connected to a bracket, the wormwheel has an axial extension on each axial end provided with a recess which can receive selectively the end of a tilt rod, whereby the tilt rod can extend either to the left or to the right of the wormwheel. A spring clip holds the tilt rod in engagement with the recess in one of the extensions. A rotational control disc may also be provided which has two external abutments.

This disc can be mounted on the other of the extensions, the abutments being engageable with stops on the bracket to restrict rotation of the control member and thus of the wormwheel. Radially outwardly extending keys are provided on each extension, one of these engaging the spring clip to hold the tilt rod in place, and the other engaging a notch in the rotation control disc to prevent the latter rotating relative to the wormwheel.

17 Claims, 7 Drawing Figures

TILTER MECHANISM

REFERENCE TO EARLIER APPLICATION

This application is a continuation in part to earlier application Ser. No. 043696 filed May 30, 1979 and now abandoned.

BACKGROUND OF THE INVENTION

The present invention relates to a tilter mechanism for the slats of a venetian blind.

Many forms of such tilter mechanism have been proposed before and these usually consist of a bracket which is mountable in the venetian blind headrail, the bracket carrying a housing in which are mounted a worm which can be rotated from the exterior, and a wormwheel which is operatively associated with the worm. A tilt rod which passes through one or more tilt rolls carrying the ladder means of the venetian blind is engaged in the wormwheel. The tilt rod is usually of non-circular, e.g. hexagonal or square cross-section, and this engages in a correspondingly shaped opening in the wormwheel.

It is an object of the present invention to provide a tilter mechanism which is capable of being mounted at either end of venetian blind headrails.

It is a further object to provide a tilter mechanism which is of compact and inexpensive construction.

In many instances, it is desirable that the venetian blind slats should only be rotatable by a restricted amount to give a pleasing appearance to the exterior of a building which has a large number of such venetian blinds therein. Certain proposals have been made for restricting the rotation of the blind but none of these is particularly satisfactory and many of them are rather expensive to manufacture. It is a further object to overcome this difficulty.

SUMMARY OF THE INVENTION

It is now proposed, according to the present invention, to provide a tilter mechanism for the slats of a venetian blind, said tilter mechanism comprising: a housing; a bracket for mounting said housing to a venetian blind headrail; an externally operable worm rotatably mounted on said housing; a wormwheel rotatably mounted on said housing in operative engagement with said worm; an axial extension at each axial end of said wormwheel; a recess in each extension adapted to receive the end of a tilt rod, whereby the tilt rod can be selected to extend either to the left or to the right of said wormwheel; engaging means on each of said extensions, each being engageable by a locking device to hold said tilt rod in place.

Such a structure can be manufactured relatively simply and the same tilter mechanism can be used whether or not one is intending to have the mechanism at one end of the blind or the other. In other words the tilt rod can extend either from the left side or from the right side of the tilter mechanism.

It is also proposed to provide a rotation control member including two abutments, said control member being mountable on the other of said extensions and for stop means to be provided on said bracket engageable by said abutments on said rotation control member to restrict rotation thereof, the engageable means on each of said extensions being engageable either by a locking device to hold said tilt rod in place or by said rotation control member, to define a particular rotational position of said control member on said other extension.

The rotation control member advantageously comprises at least one disc which has a central opening, and at least one notch extending radially outwardly from the central opening, and two radially outwardly extending abutment surfaces adjacent the outer periphery of said at least one disc, these surfaces forming the abutments mentioned above. The engaging means formed on the extensions of the wormwheel can then comprise a radially outwardly extending key on each of the axial extensions, the key being engageable in the notch or notches of the disc.

Preferably the disc has a plurality of notches which are equiangularly spaced from one another on the disc, whereby the rotational position of the disc can be chosen to give a particular rotational movement possibility for the tilt rod.

The locking device which may be provided can be a spring which can be snap-fitted over the key. For example, the locking device can be in the form of a spring clip which is mountable on the tilt rod and has an orifice adjacent one end which is engageable over the key.

A particular advantageous arrangement is one in which each key has an inclined ramp surface at the end remote from the wormwheel, the spring clip having an upturned end portion for sliding up the ramp surface, whereby the orifice can snap over the end of the key which is nearer to the wormwheel. The spring clip may, for example, comprise a V-shaped member which has openings in each arm of the V, whereby the tilt rod can be passed through the openings to mount the spring clip on the tilt rod, one arm of the V having, at its free end, a bent-down end portion which includes the orifice.

It is also contemplated, according to the present invention, to provide a rotation control member for controlling the rotation of a venetian blind tilt rod, said rotation control member comprising at least one disc having a central opening, a plurality of equiangularly spaced notches extending radially outwardly from said central opening, two radially extending abutment surfaces adjacent the outer periphery of said at least one disc, said member being mountable upon the wormwheel of a venetian blind tilter with one of the notches engaging a key on the wormwheel and the abutment surfaces being engageable with stops on the mounting bracket of the tilter to control rotation of the tilt rod.

In order that the invention may more readily be understood, the following description is given, merely by way of example, of presently preferred modes of putting the invention into effect. This description is given with reference to the accompanying drawings.

DETAILED DESCRIPTION OF THE PREFERRED EMBODIMENTS

Figure 1:
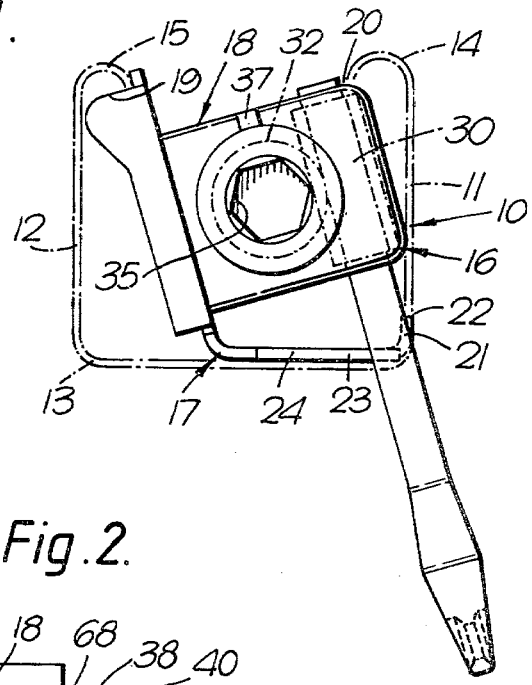
FIG. 1 is a section through a venetian blind headrail with one embodiment of tilter mechanism according to the invention mounted therein.
Figure 2:
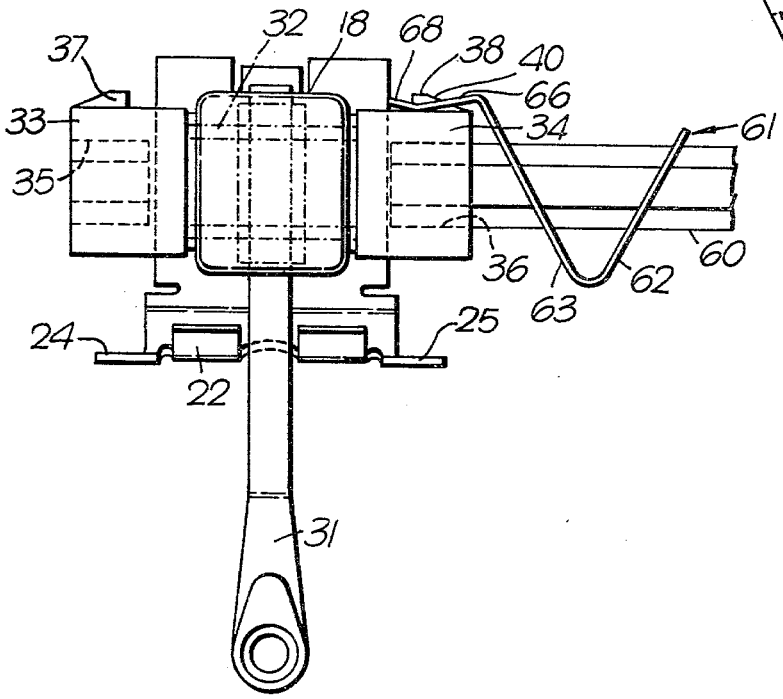
FIG. 2 is a front elevation of the tilter mechanism of FIG. 1.

The tilter mechanism illustrated in FIGS. 1 and 2 is shown as mounted in a headrail 10 having a front wall 11, a rear wall 12 and a lower web 13. The front and rear walls 11 and 12 have inturned rims 14 and 15 respectively, as is conventional.

The tilter mechanism is indicated by the general reference numeral 16 and comprises a bracket 17 on which is mounted a housing 18, the bracket having lugs 19 which engage under the rim 15 while the housing 18 has a portion 20 engaging under the rim 14.

The front bottom portion 22 of the bracket projects through an opening 21 formed in the headrail.

It will be noted that the lower wall 23 of the bracket 17 is provided with two lugs 24 and 25 which may be turned up for a reason to be explained later, with reference to FIGS. 3 to 7.

Mounted for rotation within the housing 18 is a worm 30 which may be driven by its shaft 31 connected to a conventional wand (not shown). A wormwheel 32 is rotatable about an axis perpendicular to the axis of the shaft 31 and is in operative engagement with the worm 30 so that rotation of the worm will cause rotation of the wormwheel, in a conventional manner.

Extending axially from each end of the wormwheel 32 are extensions 33 and 34 respectively, these being provided with internal blind recesses 35 and 36 and are each provided also with a radially outwardly extending key or projection 37, 38. It will be noted that each of the projections 37, 38 includes, at the end remote from the wormwheel, an inclined ramp upper surface 39, 40.

Figure 5:
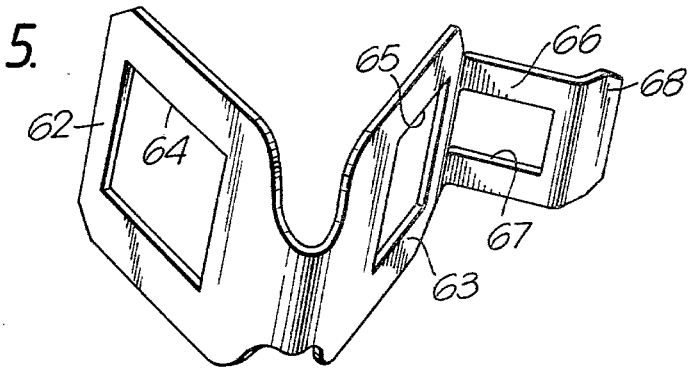
FIG. 5 is a perspective view of the spring clip locking device of the mechanism of FIGS. 1 to 4.

Engaged in the hexagonal blind recess 36, is a hexagonal tilt rod 60 and this is held in place by a spring clip 61 which is shown in greater detail in FIG. 5. The spring clip is of a generally V-shaped construction having two arms 62 and 63 provided with square cross-section holes 64 and 65. The arm 63 has, at its free end, a bent-down end portion 66 which is provided with a central orifice 67. Beyond the orifice 67 the bent-down portion is bent up again at 68.

In order to mount the tilt rod, one first of all grips the two arms 62 and 63 and squeezes them so that they move towards one another and the tilt rod 60 is passed through the openings 64 and 65 and the spring is then released. The arrangement is such that the spring clip will clamp on the tilt rod and will be difficult to move axially of the tilt rod. The square cross-section of the orifices 64 and 65 is such as to engage two of the faces of the hexagonal tilt rod and two of the angles thereof.

The tilt rod is then moved so that its end engages in the recess 36 and at this time the tip of the turn-up portion 68 will ride up the ramp surface 40 and will flex the bent-down portion 66 upwardly. Continued movement to the left, as seen in FIG. 2, will enable the orifice 67 to pass beyond the end of the ramp 40 so that it will snap down over the end of the key 38. This will then prevent the tilt rod from being moved to the right and will hold it in place. It will be appreciated that the tilt rod could equally be mounted to extend to the left, then becoming engaged in recess 35 in extension 33.

Figure 3:
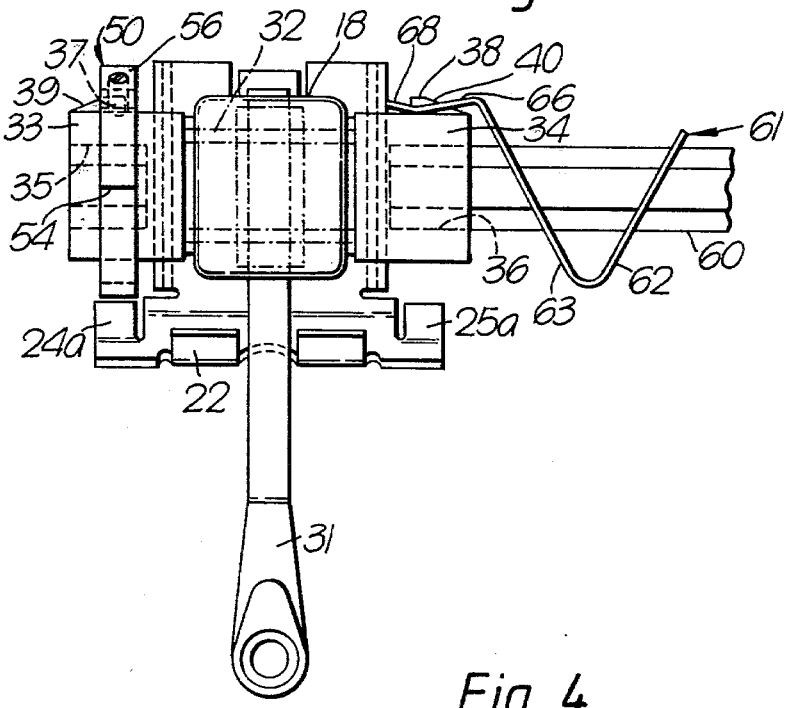
FIG. 3 is a view similar to FIG. 2, showing a presently preferred embodiment of tilter mechanism of the invention.
Figure 4:
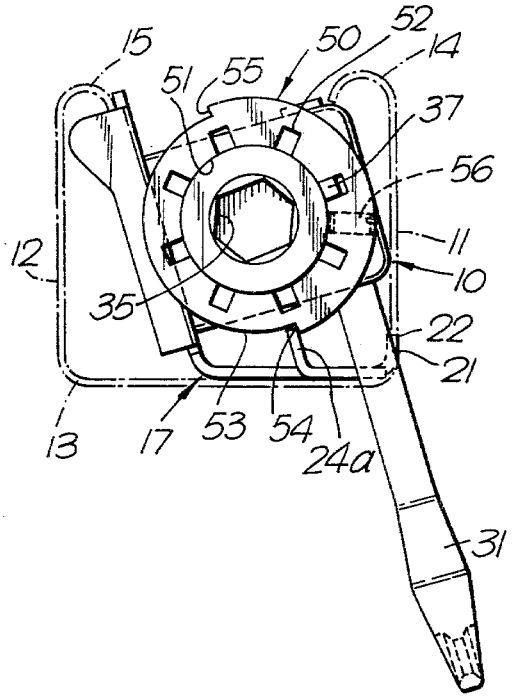
FIG. 4 is an end view of the tilter of FIG. 3 showing the rotation control member.

FIGS. 3 and 4 show a modified, presently preferred, construction, like parts being indicated by like reference numerals. The figures show the mounting of a rotation control member 50 which is a disc having approximately the same axial length as the lugs 24, 25 which are turned up to form stops 24*a*, 25*a*. The disc 50 is provided with a central opening 51 and with eight equiangularly spaced radially outwardly extending notches 52. On its outer periphery, the disc 50 has an outer circumferential portion 53 of reduced radius, this portion terminating in two abutments 54 and 55. This portion in fact extends around a control angle of, in this instance, approximately 180°. Of course, a different angle could be chosen if it were so desired.

It can be seen from FIG. 3 that the disc 50 is mounted on the extension 33 and that it is so mounted that one of the notches 52 is engaged on the key 37. In order to hold the disc in place, a grub screw 56 is provided and this is used to locate the disc at the same axial position as the stop 24.

In use, rotation of the shaft 31 by means of the wand (not shown) will cause the worm to rotate and the wormwheel also to rotate. This in turn will cause tilting of the tilt rod about its axis until the abutment 54 or 55, depending on the direction of rotation, abuts the stop 24*a*, whereupon further rotation will not be possible.

It will be appreciated that if a different angle is desired, then one simply selects a different one of the notches 52.

It will also be appreciated that this construction also can be used the other way round, that is with the tilt rod extending to the left rather than to the right and with the rotation control disc on the right rather than on the left.

The construction of the present invention is relatively simple and inexpensive to manufacture and is of universal use so that it can be operated either at one end or the other and that the facility is provided for altering the restriction of the rotation of the tilt rod, at will, to suit any particular use. This alteration can be achieved simply by selecting the particular one of the notches 52 which one uses to locate on the key 37 or 38. Of course, when the rotation control disc 50 is mounted on the extension 34 engaging the key 38, the reduced section portion 53 and the abutments 54 and 55 will cooperate with the stop 25*a* rather than the stop 24*a*.

Figure 6:
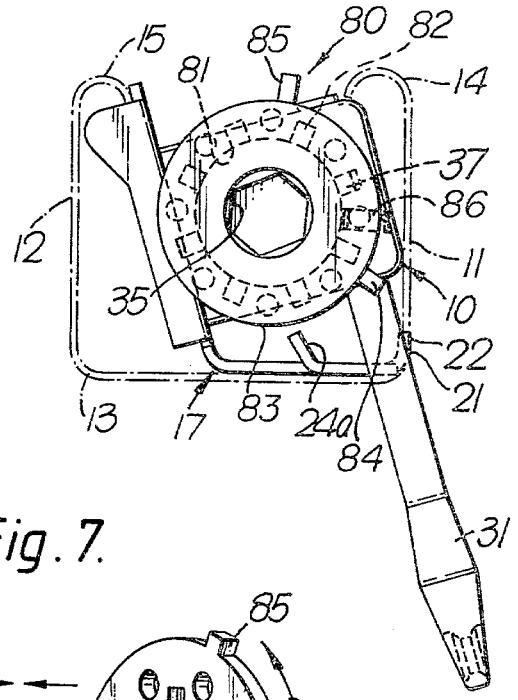
FIG. 6 is a view similar to FIG. 4, showing an alternative rotation control member.
Figure 7:
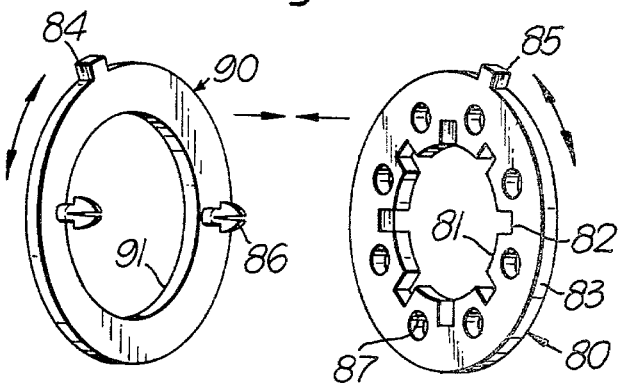
FIG. 7 is an exploded perspective view of the rotation control member of FIG. 6.

FIGS. 6 and 7 show a different form of rotation control member. A first disc 80 is provided with a central opening 81 and eight equiangularly spaced radially extending notches 82. On its outer periphery 83 the disc 80 has a radial abutment projection 85. A second disc 90 with a central opening 91 has a similar radial abutment projection 85. Two axially extending, arrow-headed bifurcated pins 86 on the disc 90 can be engaged in two of eight cooperating apertures 87 in disc 80, these being located between adjacent notches 82. Before assembly the discs are rotated relative to one another as indicated by the arrows to give the desired circumferential spacing. In a modification the discs 80 and 90 are made identical to one another and each has, for example, 7 apertures and one pin. This will reduce production costs. The assembled discs can be mounted in the same way as described above.

I claim:

1. A tilter mechanism for the slats of a venetian blind, said mechanism comprising, in combination:

(a) a housing;

(b) a bracket for mounting said housing to a venetian blind headrail;

(c) an externally operable worm rotatably mounted on said housing;
(d) a wormwheel rotatably mounted on said housing in operative engagement with said worm;
(e) an axial extension at each axial end of said wormwheel;
(f) a blind recess in each extension adapted to receive the end of a tilt rod, whereby the tilt rod can be selected to extend either to the left or to the right of said wormwheel;
(g) engaging means on each of said extensions, each being engageable by a locking device to hold said tilt rod in place.

2. A tilter mechanism as claimed in claim 1, wherein said engaging means comprises a radially outwardly extending key on each said axial extension.

3. A tilter mechanism as claimed in claim 2, and further comprising a locking device to hold said tilt rod in engagement with said recess in one of said extensions, and wherein said locking device can be snap-fitted over said projection.

4. A tilter mechanism as claimed in claim 3, wherein said locking device comprises a spring clip mountable on said tilt rod and having an orifice adjacent one end engageable over said key.

5. A tilter mechanism as claimed in claim 4, wherein said key has an inclined ramp upper surface at the end remote from said wormwheel and wherein said spring clip has an upturned end portion sliding up said ramp surface, whereby said orifice can snap over the end of said key nearer said wormwheel.

6. A tilter mechanism as claimed in claim 4, wherein said spring clip comprises a V-shaped member having openings in each arm of the V, whereby said tilt rod can be passed through said openings to mount said spring clip on said tilt rod, one arm of the V further comprising, at its free end, a bent-down end portion including said orifice.

7. A tilter mechanism for the slats of a venetian blind, said mechanism comprising, in combination:
(a) a housing;
(b) a bracket for mounting said housing to a venetian blind headrail;
(c) an externally operable worm rotatably mounted on said housing;
(d) a wormwheel rotatably mounted on said housing in operative engagement with said worm;
(e) an axial extension at each axial end of said wormwheel;
(f) a recess in each extension adapted to receive the end of a tilt rod, whereby the tilt rod can be selected to extend either to the left or to the right of said wormwheel;
(g) a rotation control member including two abutments, said control member being mountable on the other of said extensions;
(h) stop means on said bracket engageable by said abutments on said rotation control member to restrict the rotation thereof; and
(i) engaging means on each of said extensions, each being engageable either by a locking device to hold said tilt rod in place or being engageable by said rotation control member, to define a particular rotational position of said control member on said other extension.

8. A tilter mechanism as claimed in claim 7, and further comprising a locking device to hold said tilt rod in engagement with said recess in one of said extensions.

9. A tilter mechanism as claimed in claim 7, wherein the rotation control member comprises a disc having a central opening, at least one notch extending radially outwardly from said central opening, an outer circumferential portion of reduced radius terminating in said abutments and wherein said engaging means comprises a radially outwardly extending key on each said axial extension, said key being engageable in said at least one notch.

10. A tilter mechanism as claimed in claim 9, wherein said disc comprises a plurality of notches equiangularly spaced from one another on said disc, whereby the rotational position of said disc can be chosen to give a particular rotational movement possibility for said tilt rod.

11. A tilter mechanism as claimed in claim 7, wherein said engaging means comprises a radially outwardly extending key on each said axial extension.

12. A tilter mechanism as claimed in claim 11, and further comprising a locking device to hold said tilt rod in engagement with said recess in one of said extensions, and wherein said locking device can be snap-fitted over said projection.

13. A tilter mechanism as claimed in claim 12, wherein said locking device comprises a spring clip mountable on said tilt rod and having an orifice adjacent one end engageable over said key.

14. A tilter mechanism as claimed in claim 13, wherein said key has an inclined ramp upper surface at the end remote from said wormwheel and wherein said spring clip has an upturned end portion sliding up said ramp surface, whereby said orifice can snap over the end of said key nearer said wormwheel.

15. A tilter mechanism as claimed in claim 13, wherein said spring clip comprises a V-shaped member having openings in each arm of the V, whereby said tilt rod can be passed through said openings to mount said spring clip on said tilt rod, one arm of the V further comprising, at its free end, a bent up end portion including said orifice.

16. A rotation control member for controlling the rotation of a venetian blind tilt rod, said rotation control member comprising at least one disc having a central opening, a plurality of equiangularly spaced notches extending radially outwardly from said central opening, two radially extending abutment surfaces adjacent the outer periphery of said at least one disc, said member being mountable upon an extension of the wormwheel of a venetian blind tilter with one of the notches engaging a key on the extension and the abutment surfaces being engageable with stops on the mounting bracket of the tilter to control rotation of the tilt rod.

17. A tilter mechanism for the slats of a venetian blind, said mechanism comprising, in combination:
(a) a mounting bracket for mounting the mechanism securely to a venetian blind headrail;
(b) a housing connected to said bracket;
(c) an externally operable worm rotatably mounted in said housing;
(d) a wormwheel rotatably mounted in said housing in operative engagement with said worm;
(e) an axial extension on each axial end of said wormwheel;
(f) a recess in each extension adapted to receive selectively the end of a tilt rod, whereby the tilt rod can extend either to the left or the the right of said wormwheel;

(g) a V-shaped spring clip having openings in each arm of the V, whereby said tilt rod can be passed through said openings to mount said spring clip on said tilt rod, one arm of the V further comprising, at its free end, a bent up portion including an orifice;

(h) a rotation control disc having a central opening, at least one notch extending radially outwardly from said central opening, and two radially outwardly extending abutment surfaces adjacent the outer periphery of said at least one disc, said at least one control disc being mountable on the other of said extensions;

(i) stop means on said bracket engageable by said abutment surfaces on said rotation control disc to restrict rotation thereof; and (j) a radially outwardly extending key on each axial extension, one being engageable by the orifice in the end portion of said V-shaped clip, and the other being engageable by one of said notches on said at least one rotation control disc, to define a particular rotational position of said control disc on said other extension.

* * * * *